United States Patent [19]

Porter

[11] 4,020,393

[45] Apr. 26, 1977

[54] ELECTROGASDYNAMIC COATING DEVICE HAVING COMPOSITE NON-CONDUCTIVE FLOW CHANNEL, AND HOLLOW IONIZATION ELECTRODE FOR AN AIR JET

[75] Inventor: Donald H. Porter, Carlstadt, N.J.

[73] Assignee: Estey Dynamics Corporation, Red Bank, N.J.

[22] Filed: July 16, 1975

[21] Appl. No.: 596,465

[52] U.S. Cl. ..... 361/227; 239/15

[51] Int. Cl.[2] ..... B05B 5/00

[58] Field of Search ..... 317/3; 239/15

[56] References Cited

UNITED STATES PATENTS

| | | | |
|---|---|---|---|
| 3,740,612 | 6/1973 | Gauthier et al. | 317/3 |
| 3,757,491 | 9/1973 | Gourdine | 317/3 |
| 3,903,321 | 9/1975 | Schaad | 317/3 X |

*Primary Examiner*—R. N. Envall, Jr.

*Attorney, Agent, or Firm*—Anthony J. Casella

[57] ABSTRACT

Apparatus for applying powdered coating materials includes a channel portion wherein the powder coating material is passed around a conduit which delivers an air jet to the powder material, and where the powder material is ionized, and then forced through an outlet channel. The latter is made of nonconductive material, and includes a non-conductive insert disposed in the channel, with the dielectric constant of the insert being different from the dielectric constant of the material of the remainder of the channel. The ionized powder is directed by gas pressure through the channel toward a grounded object to be coated. The ionization electrode within the apparatus is hollow and an air jet is passed therethrough to aid in the dispersion of the powdered coated material.

18 Claims, 8 Drawing Figures

ELECTROGASDYNAMIC COATING DEVICE HAVING COMPOSITE NON-CONDUCTIVE FLOW CHANNEL, AND HOLLOW IONIZATION ELECTRODE FOR AN AIR JET

BACKGROUND OF THE INVENTION

The subject is an improvement over the device shown and claimed in U.S. Pat. No. 3,673,463 which issued on June 27, 1972 to M. C. Gourdine, which patent is incorporated herein by reference.

In the electrogasdynamic apparatus described in said patent, certain shortcomings have been noted with respect to accumulation or contamination of the powdered coating at the point of the electrode, as well as within the non-conducting flow channel in which the ionized particles are propelled by air pressure toward the object to be coated. More particularly, it has been found that contamination (the buildup of powdered coating material) is particularly noticeable at the collector ring, and at the electrode needle, and after a period of time of buildup, the efficiency of the electrogasdynamic apparatus is markedly decreased. Furthermore, through experimentation it has been found that the electrical charge on the particles is continually degraded with operation of the electrogasdynamic apparatus, and after relatively short periods of time, it is necessary to shut down the apparatus, and clean the entire electrogasdynamic gun assembly. As is apparent, with the constant degradation of the space charge on the particles the efficiency of the coating process is markedly decreased, and this thereby results in decreased powder output, increased cost of production, increase maintenance costs, and overall inefficient operation of the apparatus.

Accordingly, it is the object of the subject invention to overcome the shortcomings of the prior art devices, and provide a new and improved electogasdynamic gun apparatus which achieves minimum contamination at the collector ring and at the electrode needle; requires less current to operate; operates over continuously long periods of time; provides a constant or uniform nonvarying space charge to the particles; provides more efficient powder coating of the objects to be coated; increases the amount of powder material output; is cheaper to operate, requiring less maintenance and downtime; and furthermore because of the new and improved characteristics of the subject electrogasdynamic gun apparatus is capable of applying coating materials such as porcelain frit which heretofore has not been able to be applied through the use of conventional electrogasdynamic coating apparatus.

DESCRIPTION OF THE DRAWINGS

For a better understanding of these and other aspects of the invention, as well as the objects and advantages thereof, reference may be made to the following detailed description and to the drawings, in which.

DESCRIPTION OF THE PREFERRED EMBODIMENTS

Figure 1:
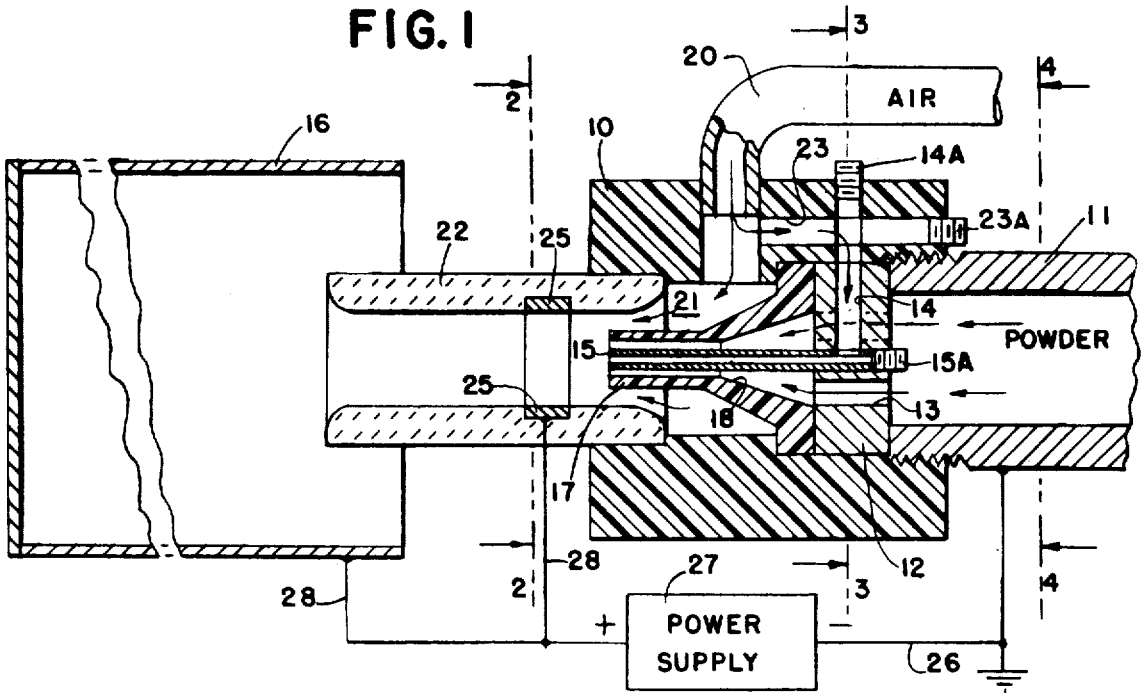
FIG. 1 is a cross sectional view of the coating device showing the internal arrangement of the conduits and jet nozzle.
Figure 2:
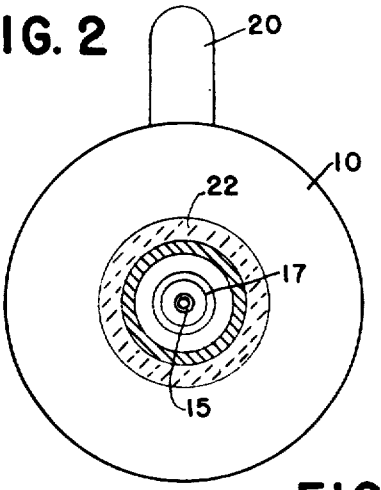
FIG. 2 is a cross sectional view of the device shown in FIG. 1 and is taken along line 2—2 of that figure.
Figure 3:
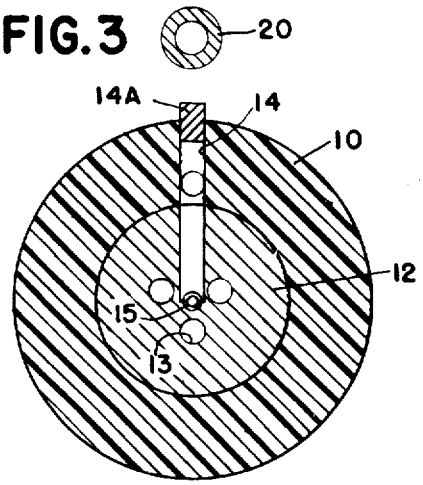
FIG. 3 is another cross sectional view of the device shown in FIG. 1 and is taken along line 3—3 of that figure.
Figure 4:
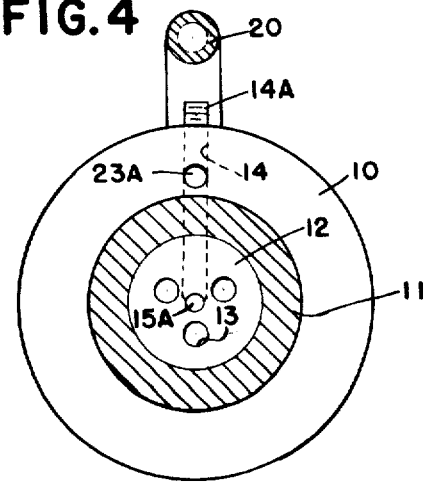
FIG. 4 is a cross sectional view of the device shown in FIG. 1 and is taken along line 4—4 of that figure.

Referring now to FIGS. 1-4, most of the components of the coating device are secured to a nonconducting block 10 preferably made of DELRIN, a trademark of an acetal resin derived by polymerization of formaldehyde and made by duPont Corp. of Wilmington, Delaware. A conductive pipe 11 is secured to the block 10 at one side and is connected to a reservoir of powder (not shown). Adjoining the end of the pipe 10 is a metal washer 12 formed with three horizontal canals 13 for the passage of the particles. The washer 12 is also formed with a vertical canal 14 for the passage of air under pressure from an air reservoir (not shown). In the center of the washer 12 a horizontal hollow needle 15 is positioned for receiving the air from canal 14 and sending it horizontally toward a container 16, the interior surface of which is to be covered with the powder carried by pipe 11. An access plug 15A normally blocks the entrance of the hollow needle 15 from pipe 11 and is removed only when cleaning is necessary.

The main flow of the particles is directed by a funnel shaped non-conductor 17 having a base portion adjoining the metal washer 12 and formed with an axial bore 18 which surrounds the needle 15. Air under pressure is forced through a pipe 20 which is connected to the upper portion of block 10, the major portion of the air passing through the annular space 21 surrounding funnel 17 and then through a flow channel 22, and finally into the inside of container 16.

A minor portion of the air from pipe 20 is diverted to a second flow path which includes a first bore 23, a second bore 14 and a corresponding hole 24 in needle 15. Pressurized air moving through this path enters the hollow needle and emerges at the center of the suspension stream through funnel 17. In this manner the stream of particles is propelled by an external air stream through opening 21, and by the axial stream through the hollow needle 15. By this arrangement, the build-up or contamination of powder on the needle, and in the vicinity of the corona discharge is inhibited, thereby insuring the continuous operation of the coating device, and the maintenance of the electrical charge developed within the coating device.

Ionization of the powder carried by the suspension may be accomplished in several ways. In U.S. Pat. No. 3,573,463, referred to above, two electrodes are mounted in the flow channel 22, diametrically opposed, and a high voltage discharge passed between them. In the present device the electrode in channel 22 is in the form of a ring 25. High voltage is then applied over conductor 26 to the pipe 11, connected to the needle 15, and a corona discharge is established between the ring 25 and the end of the needle 15. This type of discharge is believed to be more efficient since all of the particles in the suspension stream are forced through equally intense portions of the discharge.

In prior coating devices of this type there was a tendency of some of the charged particles to move back in a reverse direction and collect on one of the electrodes. The present invention corrects for this defect by the use of the two air streams, mentioned above, thereby moving all particles to the inner portion of the article 16 to be coated. The high voltage for the ionizing discharge is provided by a conventional power supply 27, the grounded end of which is connected to needle 15 and to the pipe 11.

It is obvious that the air stream through pipe 20 can be divided in many ways to produce two streams, one through the annular space 21, and the other through the hollow needle 15. The present system, using bores 23 and 14, are just one way of dividing the stream without using complicated channels. Bores 23 and 14 are plugged by threaded screws 23A and 14A, these access plugs forming a convenient means for cleaning the bores.

The operation of this device is substantially the same as the device described in the above mentioned patent. The suspension of coating particles in a gas under pressure moves from the annular space around needle 15, through the electric discharge space where the particles are given a charge, then through the channel 22 to the inside of container 16. As explained above, the space charge of the cloud of charged particles forces the outer particles toward the inside surface of the container 16. Those particles which are first attached to the surface of the conductive article loose their charge. Additional particles piled on top of the first layer provide a charge which repels other particles and the result is an even coating on all the interior surfaces.

Figure 5:
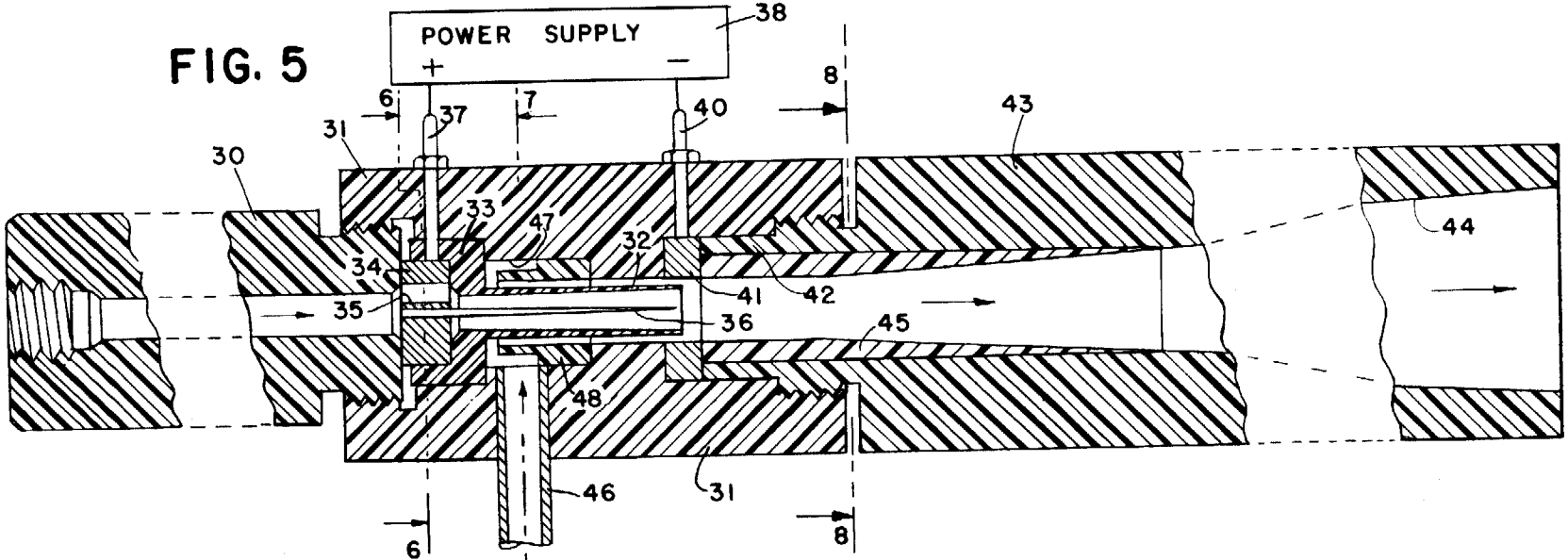
FIG. 5 is a cross sectional view of the modified form of the invention taken along a median line.
Figure 7:
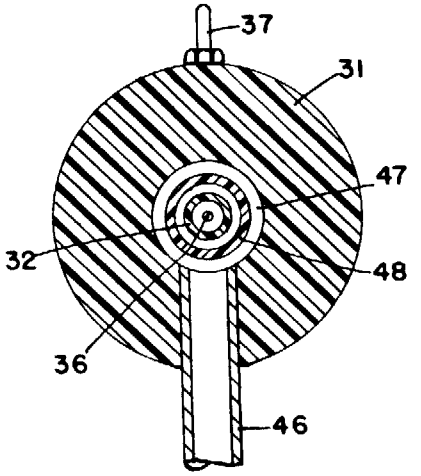
FIG. 7 is another cross sectional view of the device shown in FIG. 5 and is taken along line 7—7 of that figure.
Figure 8:
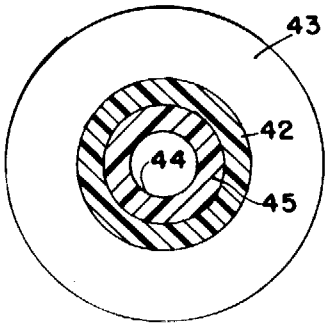
FIG. 8 is a cross sectional view of the device shown in FIG. 5 and is taken along line 8—8 of that figure.
Figure 6:
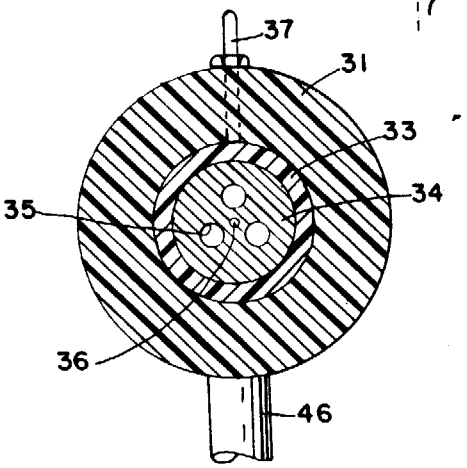
FIG. 6 is a cross sectional view of the device shown in FIG. 5 and is taken along line 6—6 of that figure.

Referring now to FIGS. 5 through 8, a modified device is shown where the powder to be deposited is moved by suction through an entrance pipe 30. Pipe 30 is connected to a powder reservoir (not shown) and is coupled, at its exit end, to an insulator block 31. The insulator block 31 is cylindrical in form and supports a thin hollow tube 32 formed integral with a circular base 33. The circular base 33 fits into a cut-out portion in the block 31 and, in turn, positions a conductive washer 34 similar to the washer 12 shown in FIG. 1. Washer 34 is securely held in place by the end of entrance pipe 30 and a depression in base 33. The washer 34 contains three holes 35 (see also FIG. 6) for the passage of powder and supports a long thin needle 36 which is used to ionize the powder particles as they are forced through the insulator block 31. Washer 34 is preferably made of brass and is connected to a conductive terminal 37 diametrically positioned in block 31 and passing through a portion of the base 33. At its outer end, the terminal 37 is connected to a power supply 38 which provides the ionizing potential for the anode needle 36.

The negative terminal of the power supply 38 is connected to a second terminal 40 which is connected, at its lower end, to a conductive cathode ring 41, held in block 31 by an annular extension 42 of a flow tube 43. The flow tube 43 is cylindrical in shape and is secured to block 31 by a threaded coupling. It is formed with an axial flow channel 44 which has the same diameter as the inside diameter of the cathode ring 41 at one end and increases its diameter to about three times at the other or exit end. The flow channel is a nonconductor, preferably made of DELRIN, and includes a nonconductive insert 45 made of tetrafluoroethylene (TEFLON) which extends from the anode ring 41 to a position about one-third of the length of the flow channel 44.

Compressed air is used to create a partial vacuum in the insulator block by aspirator action. Then the same flow of air propels the powder through an ionizing space and through the flow channel 44 to the article to be coated. The compressed air enters a side tube 46 and moves to an annular space 47 within the block 31 adjoining an insulator ring 48. The air is then expelled through the annular space between the hollow tube 32 and the inside surface of block 31. As the air passes into channel 44 past the anode ring 41 the aspirator action draws air from the inside of tube 32 and creates a suction which moves the powder particles from their reservoir (not shown), through the entrance pipe 30, holes 35, and then through the inside of hollow tube 32. As the powder particles move out of tube 32 the electrical discharge between the needle 36 and the anode ring 41 ionizes the particles and they are then mixed with the air stream and forced through the channel 44 to the work piece to be coated.

The volume of powder supplied to the apparatus can be varied by inserting a needle valve in series with conduit 14, installed in place of plug 14A.

The Teflon insert has been added to the channel 44 to prevent the accumulation of powder on the channel walls near the anode ring 41. The efficiency of such an arrangement has been proven by the continuous operation of such a device for many hours without any buildup of powder inside the channel 44. This action is caused by the generation of a positive electrostatic charge on the surface of the Teflon. This charge is due to the friction of the stream of air and particles as they pass through the channel 44. The particles are charged to a positive potential by the electric discharge between the needle 36 and the cathode ring 41 and are therefore repelled by the surface charge on the Teflon.

Accordingly there is provided a new and improved electrogasdynamic gun apparatus for applying coated material whether of the wet paint type, or of the dry powdered type. It has been found in experimentation that the employment of the composite channel 41, including the Teflon insert 42 and the main body of the channel 44 which is made of DELRIN has resulted in new and surprising results not heretofore obtained employing conventional coating apparatus. More particularly, in actual experimentation it has been found that there is minimum contamination both at the collector ring or anode ring 41, as well as minimum contamination of the coating particles at the electrode needle 36. Less power has been required for the development of the sufficient electrostatic charge on the coating particles to result in an efficient coating of the objects to be coated, and it has been found that over extended periods of time, there has been minimal degradation in the charge on the coating particles. As a result, more efficient powder coating has been obtained, and most importantly, it has been found that increased powder coating output has been obtained. In experimentations, it has been found that greater efficiencies on the order of 1000% increase in the amount of powder capable of being passed through the apparatus and effectively applied to grounded objects to be coated. It has also been found that certain coating materials, such as porcelain frit have been successfully employed in coating of objects utilizing the subject apparatus, whereas such coating materials were not effectively and efficiently employed in prior apparatus.

The result of these new and surprising results have thus enabled the subject apparatus to be operated at less expense, requiring less maintenance, less down time, and increased production.

It will thus be seen that the objects set forth above are efficiently obtained, and certain changes may be made in the above constructions without departing from the spirit and scope of the invention, and it is intended that matter contained in the above description and shown in the accompanying drawings shall be interpreted as illustrative only and not in a limiting sense.

The embodiments of the invention in which an exclusive property or privilege is claimed as defined as follows:

1. An electrogasdynamic system for applying a coating to an article comprising:

a. a non-conductive conduit for conveying a stream of particles from a reservoir and for directing the particles toward the article to be coated;

b. a conductive needle axially positioned within said conduit for forming a corona discharge to ionize the particles passing through the adjoining space;

c. an electrode adjacent to the needle for forming an electric field between the electrode and the needle;

d. a source of potential connected between the electrode and the needle for creating a corona discharge;

e. an axial flow channel for forming a non-conductive boundary for the ionized particles as they move toward an article to be coated; and f. an insert of tetrafluoroethylene which is positioned within said flow channel adjacent to said electrode for assuming an electric charge and thereby repulsing the ionized particles.

2. A system as claimed in claim 1 wherein said electrode is a conductive ring embedded in the flow channel and connected to a terminal of the electric power source.

3. A system as claimed in claim 1 wherein said axial flow channel is directed toward the interior of a conductive article for coating its interior surface.

4. A system as claimed in claim 1 wherein said nonconductive conduit is part of a block which includes a support for the non-conductive flow chamber.

5. A system as claimed in claim 1 wherein a conductive washer is positioned adjoining the non-conductive conduit and supports said conductive needle.

6. A system as claimed in claim 5 wherein said conductive washer is formed with a plurality of holes for passage of the particles.

7. An electrogasdynamic system for applying a coating to an article comprising:

a. a non-conductive conduit for conveying a stream of particles from a reservoir and for directing the particles toward the article to be coated;

b. a conductive needle axially positioned within said conduit for forming a corona discharge to ionize the particles passing through the adjoining space, said conductive needle being hollow and positioned for receiving air under pressure from an air reservoir for passage of the pressurized air through said needle and towards the article to be coated;

c. an electrode adjacent to the needle for forming an electric field between the electrode and the needle;

d. a source of potential connected between the electrode and the needle for creating a corona discharge; and, e. an axial flow channel for forming a non-conductive boundary for the ionized particles as they move toward an article to be coated, said particles being aided in moving through said flow channel by the air received by said hollow conductive needle.

8. A system as claimed in claim 7 wherein said electrode is a conductive ring embedded in the flow channel and connected to a terminal of the electric power source.

9. A system as claimed in claim 7 wherein said axial flow channel is directed toward the interior of a conductive article for coating its interior surface.

10. A system as claimed in claim 7 wherein said nonconductive conduit is part of a block which includes a support for the nonconductive flow chamber.

11. A system as claimed in claim 7 wherein a conductive washer is positioned adjoining the nonconductive conduit and supports said conductive needle.

12. A system as claimed in claim 11 wherein said conductive washer is formed with a plurality of holes for passage of the powder.

13. A nonconducting channel for the transfer of nonconducting particles propelled by an air stream under pressure, said channel made of a material which generates one type of static charge when subjected to the frictional engagement of the moving particles; said channel containing a nonconductive insert in the channel wall made of a material which generates the opposite type of static charge when subjected to the frictional engagement of the moving particles.

14. A channel as claimed in claim 13 wherein said channel is made of an acetal resin of formaldehyde and wherein the insert is made of tetrofluoroethylene.

15. A nonconductive channel for the transfer of nonconductive particles propelled by an air stream under pressure, said channel being of composite construction including a first dielectric material, and an insert coaxial with and coextensive with said first material, the dielectric constant of said second material being different than the dielectric constant of said first material.

16. A method of applying a coating of particles to the interior of an article, said particles to be passed through a hollow non-conductor containing a hollow conductive nozzle, said method comprising the steps of forcing pressurized air along the external surface of the hollow non-conductor towards the article to be coated; forcing pressurized air through the hollow conductive nozzle towards the article to be coated; forcing the particles from a reservoir through an annular opening surrounding said hollow conductive nozzle; ionizing the particles by passing an electric discharge therethrough, said ionized particles being propelled by the air stream along the external surface of the hollow non-conductor and by the axial air stream through the hollow conductive nozzle through a non-conductive flow channel toward the interior of the article to be coated.

17. An electrogasdynamic system for applying a coating to an article comprising:

a. a non-conductive conduit for conveying a stream of powder particles from a reservoir and for directing the particles toward the article to be coated;

b. a conductive needle axially positioned within said conduit for forming a corona discharge to ionize the particles passing through the adjoining space;

c. an electrode adjacent to the needle for forming an electric field between the electrode and the needle;

d. a source of potential connected between the electrode and the needle for creating a corona discharge;

e. an axial flow channel for forming a non-conductive boundary for the ionized particles as they move toward an article to be coated, said axial flow channel being made of an acetal resin of formaldehyde; and f. an insert of tetrafluorethylene disposed adjacent to said electrode for forming the electric field.

18. An electrogasdynamic system for applying a coating to an article comprising:

a. a non-conductive conduit for conveying a stream of particles from a reservoir and for directing the particles toward the article to be coated;

b. a conductive needle axially positioned within said conduit for forming a corona discharge to ionize the particles passing through the adjoining space;

c. an electrode adjacent to the needle for forming an electric field between the electrode and the needle;

d. a source of potential connected between the electrode and the needle for creating a corona discharge; and e. an axial flow channel for forming a non-conductive boundary for the ionized particles as they move toward an article to be coated, said channel being made of a material which generates one type of static charge when subjected to the frictional engagement of moving particles, and wherein an insert is disposed within the channel, said insert made of a material which generates the opposite type of static charge when subjected to the frictional engagement of the moving particles.

* * * * *